US008317666B2

(12) United States Patent
Wang

(10) Patent No.: US 8,317,666 B2
(45) Date of Patent: Nov. 27, 2012

(54) WEIGHTLIFTING APPARATUS

(76) Inventor: Tony Wang, Kaohsiung (TW)

( * ) Notice: Subject to any disclaimer, the term of this patent is extended or adjusted under 35 U.S.C. 154(b) by 124 days.

(21) Appl. No.: 13/017,233

(22) Filed: Jan. 31, 2011

(65) Prior Publication Data

US 2012/0196728 A1 Aug. 2, 2012

(51) Int. Cl.
*A63B 21/075* (2006.01)

(52) U.S. Cl. ..... 482/106; 482/93

(58) Field of Classification Search ..... 482/55, 482/92–94, 98, 106–109, 111; 446/8
See application file for complete search history.

(56) References Cited

U.S. PATENT DOCUMENTS

| | | | | | |
|---|---|---|---|---|---|
| 980,025 | A * | 12/1910 | Titus | 482/108 |
| 984,721 | A * | 2/1911 | Titus | 482/108 |
| 1,524,888 | A * | 2/1925 | Schuur | 482/108 |
| 4,121,826 | A * | 10/1978 | Liberatore | 482/108 |
| 4,311,306 | A * | 1/1982 | Solloway | 482/111 |
| 4,480,829 | A * | 11/1984 | Yacoboski | 482/111 |
| 4,482,151 | A * | 11/1984 | Zwilling | 482/106 |
| 5,871,423 | A * | 2/1999 | Pruchnik | 482/110 |
| 6,837,833 | B2 * | 1/2005 | Elledge | 482/108 |
| 7,014,598 | B2 * | 3/2006 | Fenelon et al. | 482/107 |
| 7,654,939 | B1 * | 2/2010 | Lin | 482/93 |
| 8,033,965 | B1 * | 10/2011 | Krull | 482/108 |
| 2006/0160675 | A1 * | 7/2006 | Brown | 482/93 |

* cited by examiner

*Primary Examiner* — Loan Thanh
*Assistant Examiner* — Victor K Hwang
(74) *Attorney, Agent, or Firm* — Alan Kamrath; Kamrath IP Lawfirm, PA

(57) ABSTRACT

A weightlifting apparatus has multiple disc weights. Each disc weight has a round base and a round cover assembled on the round base. The round base has multiple locating slots formed therein. The round cover has multiple locating holes formed therethrough. When the locating slots align with the locating holes, lightweight weight plates or coins can be inserted into corresponding locating slots. When the locating slots misalign with the locating holes, the inserted weight plates or coins can be retained in the locating slots. Accordingly, easy weight adjustment and cost-saving effect can be achieved without requiring users to purchase an entire set of disc weights. With incremental fine weight adjustment of weight plates and coins, users can quickly adapt to the adjusted weight, and the exercise injury caused by large increment of weight adjustment can be avoided.

14 Claims, 10 Drawing Sheets

WEIGHTLIFTING APPARATUS

BACKGROUND OF THE INVENTION

1. Field of the Invention

The present invention relates to a weightlifting apparatus, and more particularly to a weightlifting apparatus having multiple disc weights respectively mounted on two ends of a bar for weightlifting exercise and selectively added with weight plates or coins therein to achieve fine weight adjustment to the original disc weights.

2. Description of the Related Art

Workout with disc weights, dumbbells, barbells and the like can build up muscle lines, muscle strength and endurance. In general, disc weights take a form of a single plate, and can be held with one hand or two hands in weightlifting exercise.

The dumbbells pertain to small weightlifting equipment. Each dumbbell has a short metal bar and multiple weights respectively and adjustably mounted on two ends of the metal bar, and is good for weightlifting exercise with one hand. Each barbell has a long metal bar and multiple disc weights respectively and adjustably mounted on two ends of the metal bar, and is good for weightlifting exercise with two hands due to its heaviness.

The disc weights are usually made of cast iron and have various choices of weight, for example 2.5 kg, 5 kg, 10 kg and so on, so that users can vary the combination of weight choices by selectively mounting the disc weights on two ends of the metal bar of a barbell based on personal workout preference.

To have a complete combination of disc weights in weight adjustment, a whole set of disc weights having all kinds of weight choices is preferred to be available. However, buying a whole set of disc weights could be a financial burden to users. Furthermore, given the above choices of weight for disc weights as an example, the minimum weight adjustment is done by two 2.5 kg disc weights added on or removed from two ends of the metal bar. This means that 5 kg is the minimum weight adjustment users can add or reduce each time. Such a large increment in weight may overload users and easily cause muscle sprain and strain during weightlifting exercise.

SUMMARY OF THE INVENTION

An objective of the present invention is to provide a weightlifting apparatus having multiple disc weights respectively mounted on two ends of a bar for weightlifting workout and selectively added with weight plates or coins therein to achieve fine weight adjustment to the original disc weights.

To achieve the foregoing objective, the weightlifting apparatus has multiple disc weights. Each disc weight has a round base, an engagement tab and a round cover.

The round base has an annular sidewall, an annular flange, at least one limiting rib, at least one sliding space, a center hole, multiple locating slots and a fixing slot.

The annular flange is formed on and protrudes from the annular sidewall of the round base.

Each one of the at least one limiting rib is formed on the annular sidewall of the round base, and has a fence portion, a stop portion and an opening. The fence portion is circumferentially formed on the annular sidewall. The stop portion is formed between one end of the fence portion and the annular flange. The opening is formed between the other end of the fence portion and the annular flange, and is opposite to the stop portion.

Each one of the at least one sliding space is defined between the annular flange and a corresponding limiting rib.

The center hole is centrally formed through the round base.

The locating slots and the fixing slot are formed in one side of the round base opposite to the annular flange.

The engagement tab has a slider and a lever. The slider is slidably mounted in the fixing slot of the round base. The lever is mounted on the slider and protrudes beyond the fixing slot.

The round cover has a circuit board, an annular wall, an open chamber, at least one recess, at least one locating pin, a center hole, multiple locating holes and an arced hole. The annular wall is formed on a perimeter of the circular board. The open chamber is defined by the circular board and the annular wall. The at least one recess is formed in an inner wall of the annular wall and is equal to the at least one limiting rib in number. Each one of the at least one locating pin is formed on an inner wall of one of the at least one recess. The center hole is centrally formed through the circular board. The locating holes are formed through the circular board. The arced hole is formed through the circular board and has a curved end located at one end of the arced hole and communicating with the rest portion of the arced hole.

When the round cover is mounted on the round base, the at least one recess respectively corresponds to and aligns with the at least one limiting rib, an arc length of each one of the at least one recess is longer than that of each one of the at least one limiting rib, each one of the at least one locating pin is mounted in a corresponding sliding space through the opening of a corresponding limiting rib, the lever of the engagement tab is inserted in the curved end of the arced hole and is moved to one end of the arced hole opposite to the curved end so that the locating holes of the round cover respectively align with the locating slots of the round base.

The locating holes of the round cover and the locating slots of the round base can be conveniently rotated to align or misalign with each other so that additional weight can be added to the disc weights by inserting multiple weight plates or coins into the locating slots and retaining the weight plates or coins in the locating slots.

Additionally, easy fine weight adjustment can be achieved with the use of lightweight weight plates or coins. Users will not incur exercise injury during a weightlifting workout as a result of the fine weight adjustment.

Moreover, as the weight of the disc weight can be adjusted with the insertion of the weight plates or coin into the corresponding locating slots, buying an entire set of disc weights with different weights is unnecessary and a cost-saving effect is achieved.

Other objectives, advantages and novel features of the invention will become more apparent from the following detailed description when taken in conjunction with the accompanying drawings.

DETAILED DESCRIPTION OF THE INVENTION

Figure 1:
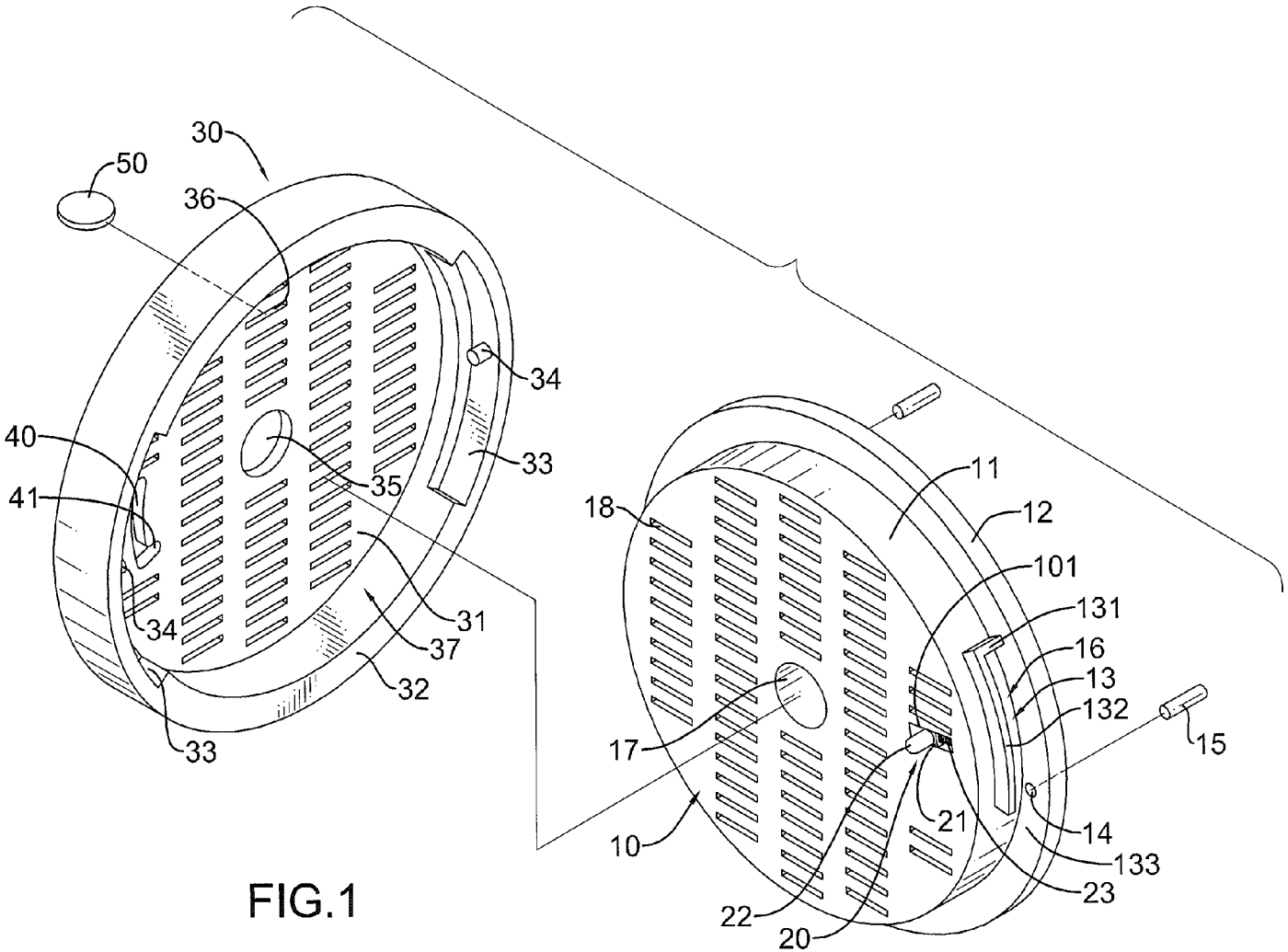
FIG. 1 is an exploded perspective view of a first embodiment of a disc weight of a weightlifting apparatus in accordance with the present invention.
Figure 2:
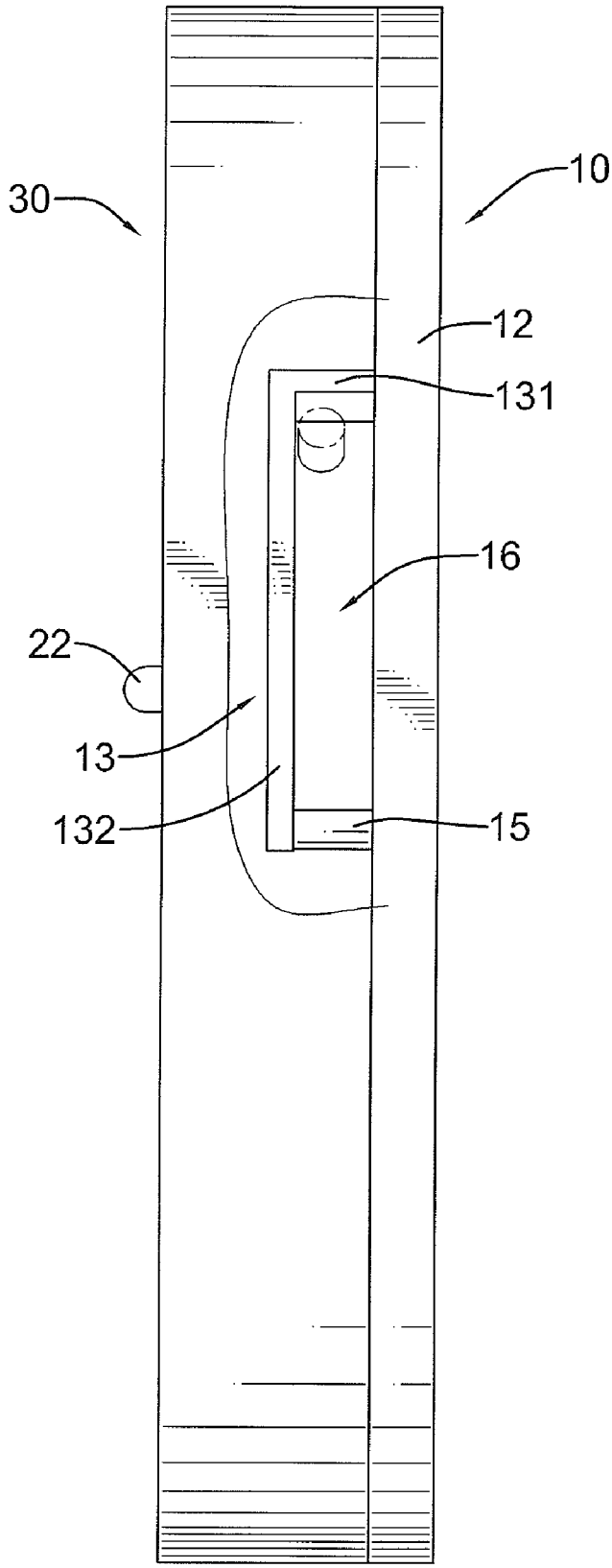
FIG. 2 is a side view in partial section of the disc weight in FIG. 1.
Figure 3:
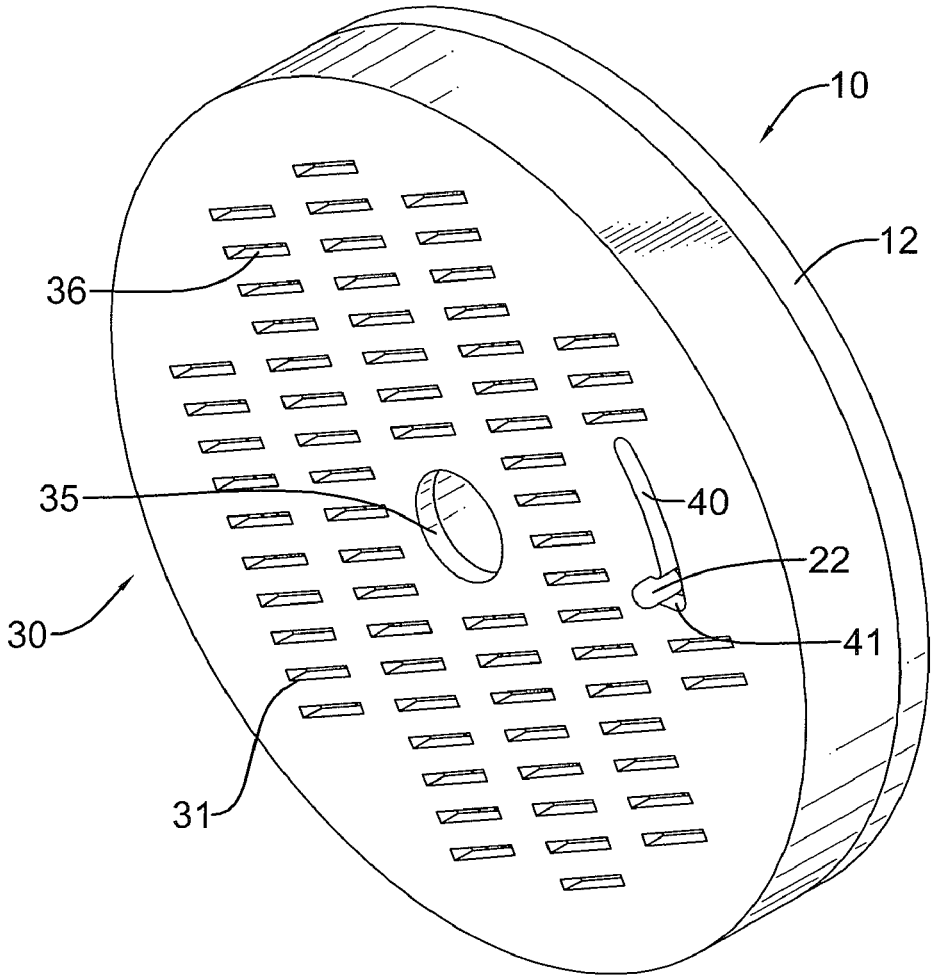
FIG. 3 is a perspective view of the disc weight in FIG. 1.

With reference to FIGS. 1 to 3, 6 and 10, a first embodiment of a disc weight of a weightlifting apparatus in accordance with the present invention has a round base 10, an engagement tab 20 and a round cover 30.

The round base 10 is disk-shaped, and has an annular flange 12, at least one limiting rib 13, a through hole 14, a blocking pin 15, at least one sliding space 16, a center hole 17, multiple locating slots 18 and a fixing slot 101. The annular flange 12 is formed around and protrudes from an annular sidewall 11 of the round base 10. Each one of the at least one limiting rib 13 is L-shaped and formed on the annular sidewall 11 of the round base 10, and has a fence portion 132, a stop portion 131 and an opening 133. The fence portion 132 is circumferentially formed on the annular sidewall 11. The stop portion 131 is formed between one end of the fence portion 132 and the annular flange 12. The opening 133 is formed between the other end of the fence portion 132 and the annular flange 12, and is opposite to the stop portion 131. The through hole 14 is formed through the annular flange 12 and aligns with the opening 133 of one of the at least one limiting rib 13. The blocking pin 15 is mounted through the through hole 14 to block the opening 133 of a corresponding limiting rib 13. Each one of the at least one sliding space 16 is defined between the annular flange 12 and a corresponding limiting rib 13. The center hole 17 is centrally formed through the round base 10. The multiple locating slots 18 and the fixing slot 101 are formed in one side of the round base 10 opposite to the annular flange 12.

The engagement tab 20 has a slider 21, a lever 22 and a spring 23. The slider 21 is slidably mounted in the fixing slot 101. The lever 22 is mounted on the slider 21 and protrudes beyond the fixing slot 101. The spring 23 is mounted in the fixing slot 101. One end of the spring 23 abuts against an inner wall of the fixing slot 101, and the other end of the spring 23 abuts against one side of the slider 21.

The round cover 30 has a circular board 31, an annular wall 32, an open chamber 37, at least one recess 33, at least one locating pin 34, a center hole 35, multiple locating holes 36 and an arced hole 40. The annular wall 32 is formed around a perimeter of the circular board 31. The open chamber 37 is defined by the circular board 31 and the annular wall 32. The at least one recess 33 is formed in an inner wall of the annular wall 32, and is equal to the at least one limiting rib 13 in number. Each one of the at least one locating pin 34 is formed on an inner wall of one of the at least one recess 33. The center hole 35 is centrally formed through the circular board 31. The locating holes 36 and the arced hole 40 are formed through the circular board 31. The arced hole 40 has a curved end 41 located at one end of the arced hole 40 and communicating with the rest portion of the arced hole 40.

Figure 4:
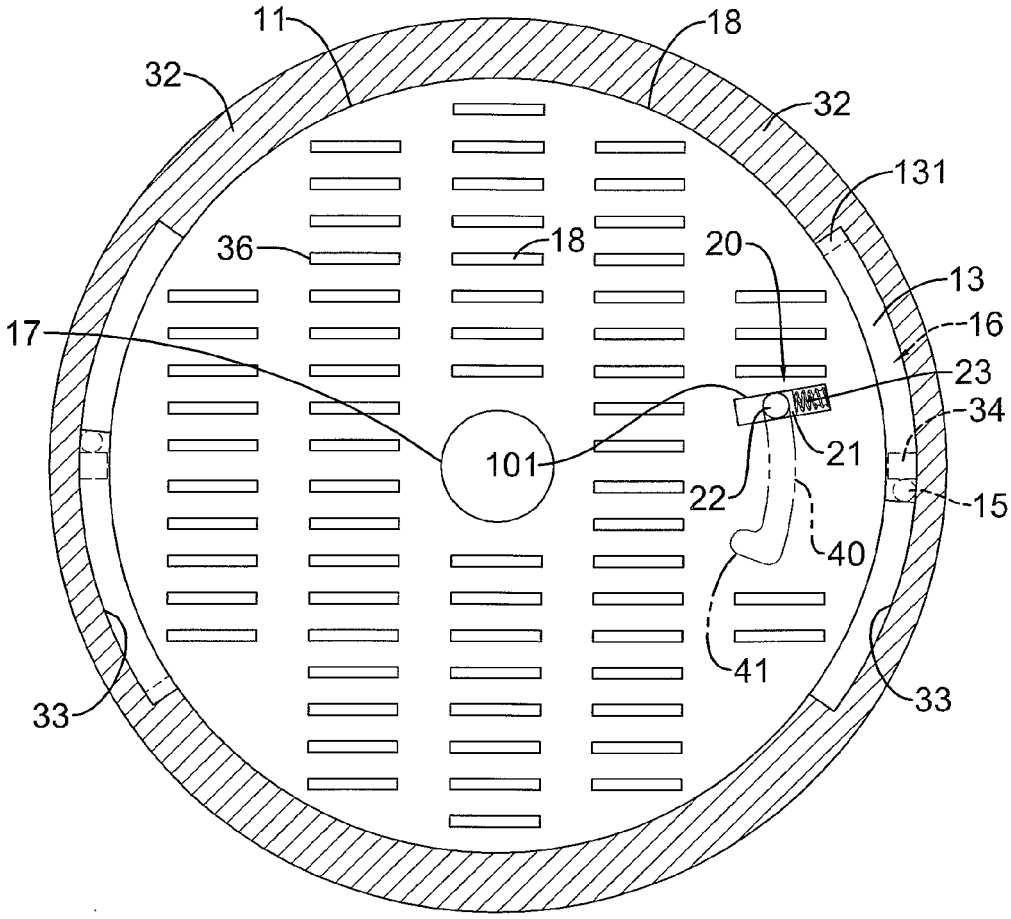
FIG. 4 is an operational cross-sectional front view of the disc weight in FIG. 1.

With reference to FIG. 4, when the round cover 30 is mounted on the round base 10, the at least one recess 33 respectively corresponds to and aligns with the at least one limiting rib 13. As the arc length of each one of the at least one recess 33 is longer than that of each one of the at least one limiting rib 13, each one of the at least one locating pin 34 can be mounted in a corresponding sliding space 16 through the opening 133 of a corresponding limiting rib 13. After the lever 22 of the engagement tab 20 is inserted in the curved end 41 of the arced hole 40 and is moved to depart from the curved end 41, the round cover 30 can be rotated relative to the round base 10 so that the lever 22 can be moved relative to the round cover 30 to one end of the arced hole 40 opposite to the curved end 41, and the locating holes 36 of the round cover 30 respectively align with the locating slots 18 of the round base 10.

Figure 5:
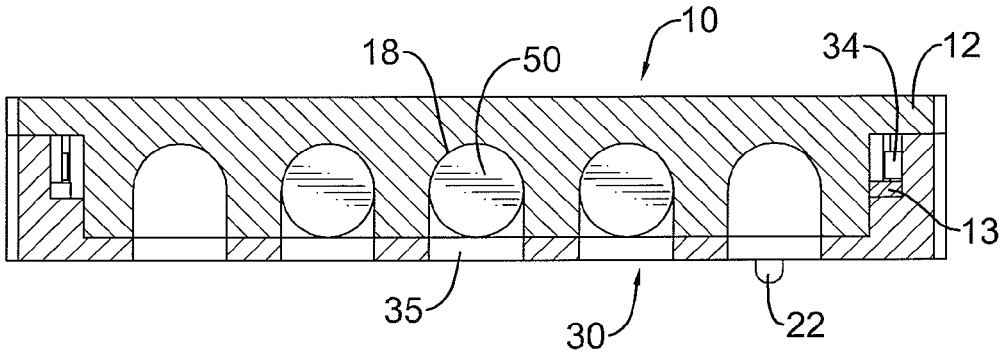
FIG. 5 is an operational top view in partial section of the disc weight in FIG. 1 added with weight plates.
Figure 6:
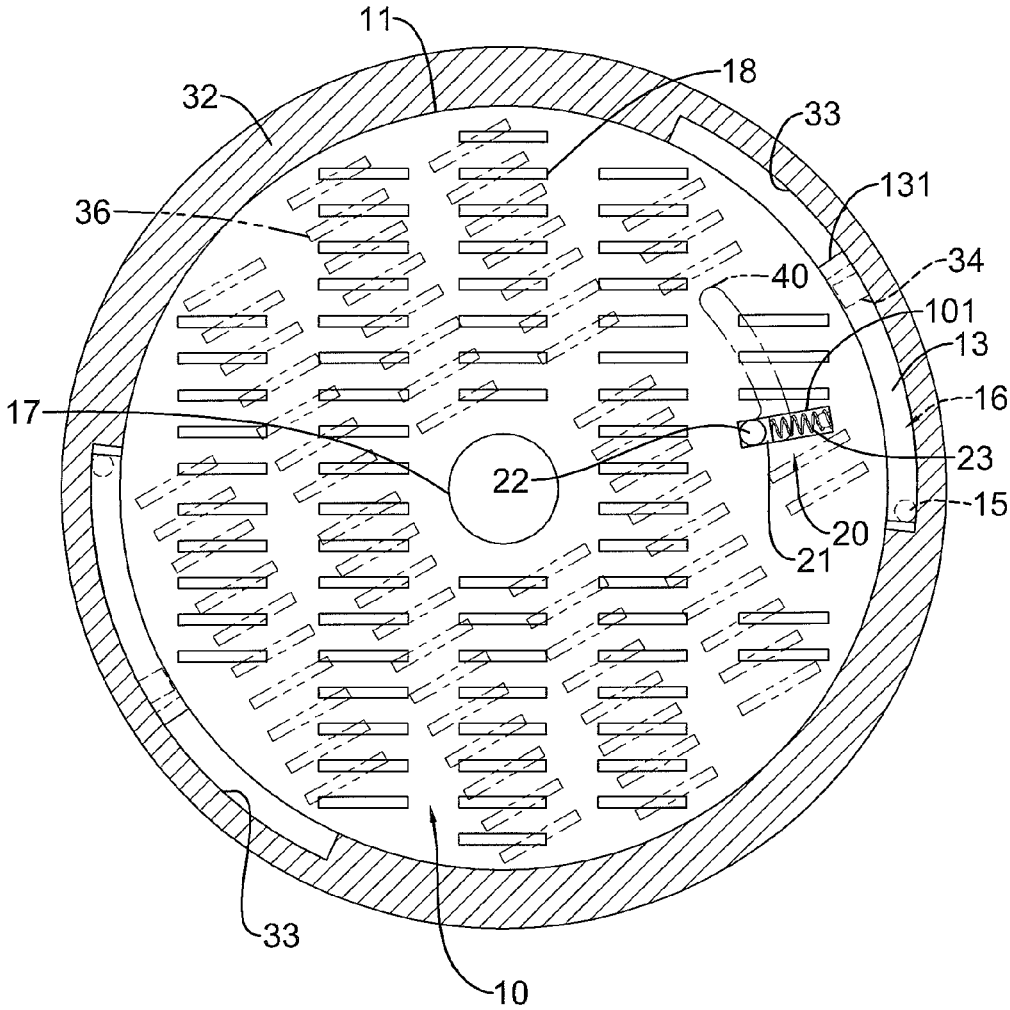
FIG. 6 is another operational cross-sectional front view of the disc weight in FIG. 1.

With reference to FIGS. 5 and 6, after three weight plates 50 or coins are respectively inserted into three locating slots 18 through three corresponding locating holes 36 respectively aligning with the locating slots 18, the round cover 30 can be rotated relative to the round base 10 so that the locating holes 36 misalign with the locating slots 18. Additionally, the slider 21 of the engagement tab 20 is moved to the opposite end of the arced hole 40 and is pushed by the pre-compressed elastic force of the spring 23 to abut against a closed end of the curved end 41 of the arced hole 40 so as to engage the round cover 30 and the round base 10. Due to the misalignment of the locating holes 36 and the locating slots 18, the weight plates or coins are respectively retained in the locating slots 18. Each of the at least one blocking pin 15 is further inserted into a corresponding through hole 14 to block the opening 133 of a corresponding limiting rib 13 and prevent the locating pin 34 from coming off from a corresponding sliding space 16.

Figure 7:
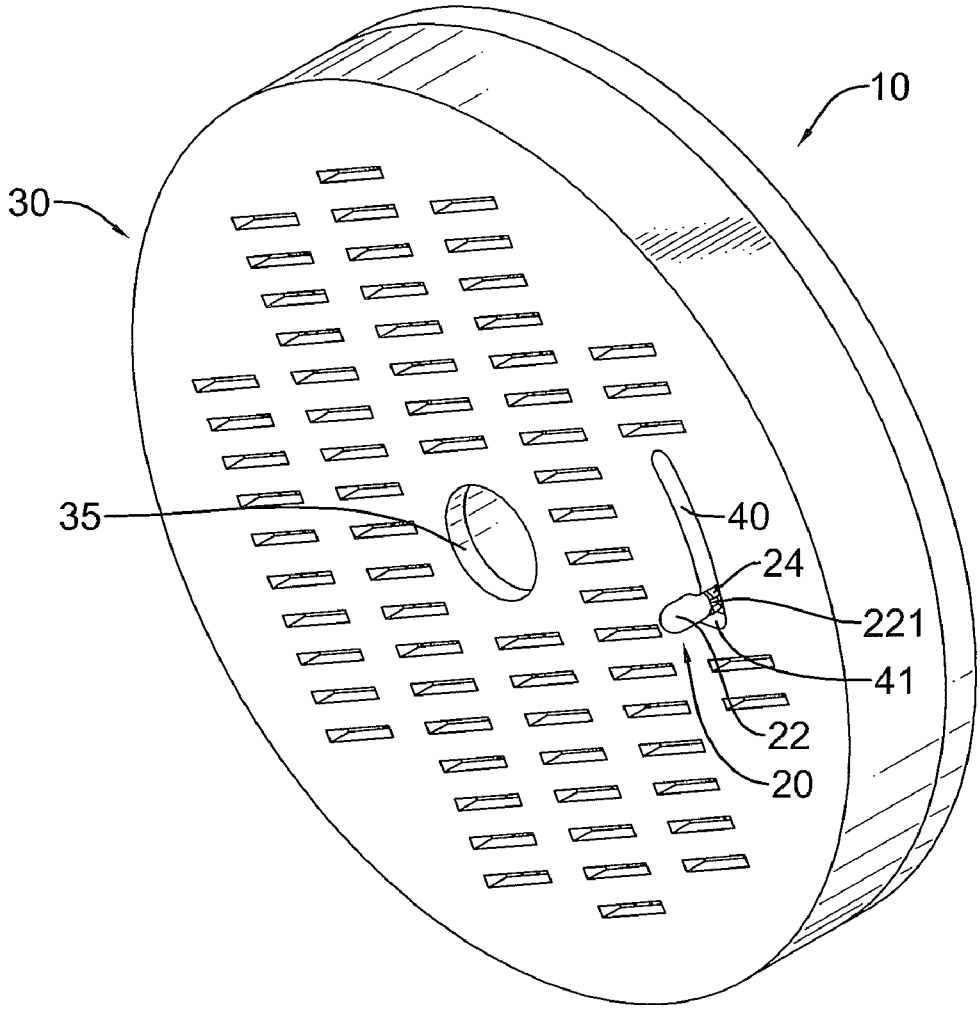
FIG. 7 is a perspective view of a second embodiment of a disc weight of a weightlifting apparatus in accordance with the present invention.
Figure 9:
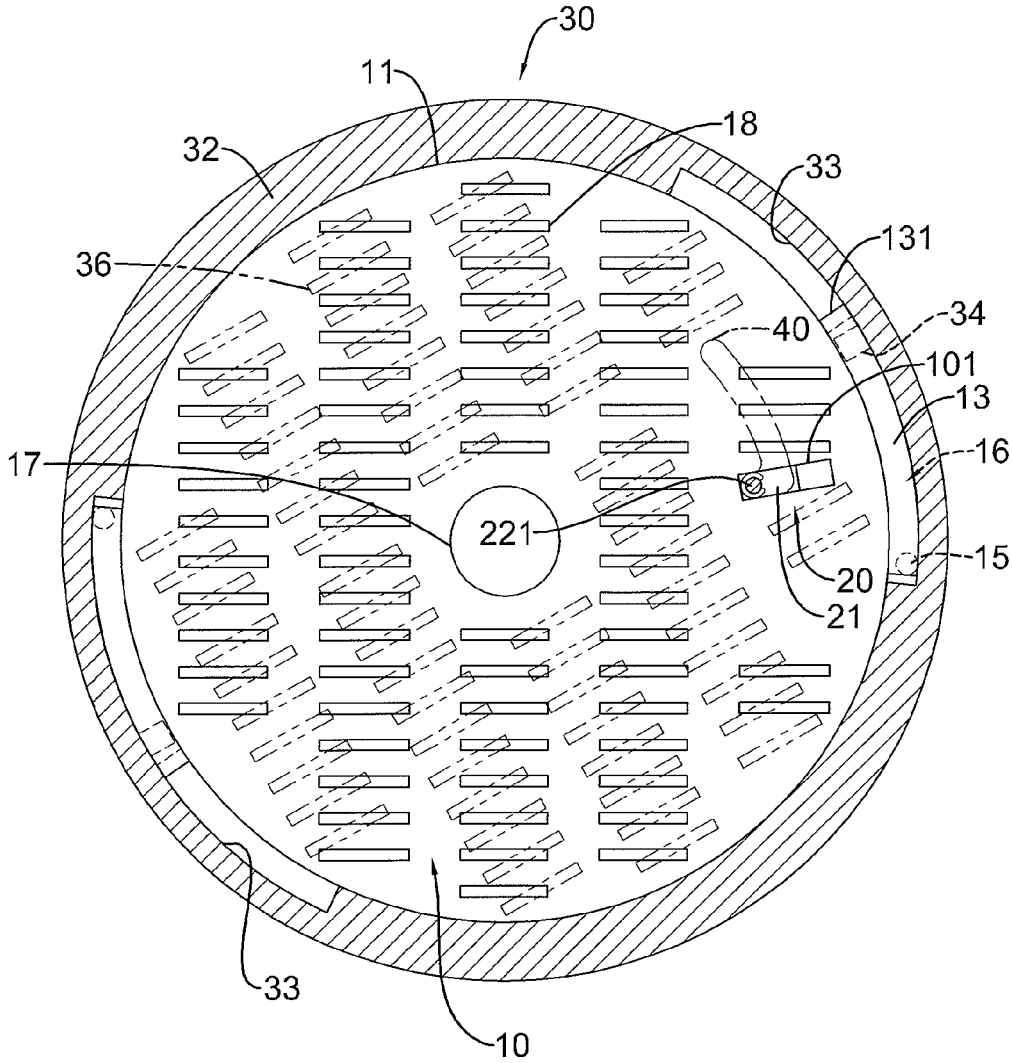
FIG. 9 is another operational cross-sectional front view of the disc weight in FIG. 7.

With reference to FIGS. 7 and 9, a second embodiment of a disc weight of a weightlifting apparatus in accordance with the present invention differs from the first embodiment in the engagement tab 20. The engagement tab 20 has a slider 21 and a lever 22. The slider 21 is slidably mounted in the fixing slot 101. The lever 22 is mounted on the slider 21 and through the arced hole 40 of the round cover 30, and protrudes beyond the fixing slot 101. The curved end 41 has two bumps being adjacent to the closed end of the curved end 41 and formed on two opposite inner walls of the curved end 41. When being moved to the closed end of the curved end 41 of the arced hole 40, the lever 22 abuts against the bumps and is held by the bumps. The lever 22 can be pushed to disengage from the bumps and moved to the end of the arced hole 40 opposite to the curved end 41. In another embodiment, the bumps of the curved end 41 are replaced by a C-shaped retaining clip 24, and a reduced neck 221 is formed at a junction between the lever 22 and the slider 21. When the lever 22 is pushed to move to the closed end of the curved end 41 of the arced hole 40, the reduced neck 221 is retained and positioned by the retaining clip 24 as shown in FIG. 9, and the locating slots 18 misalign with the locating holes 36.

Figure 8:
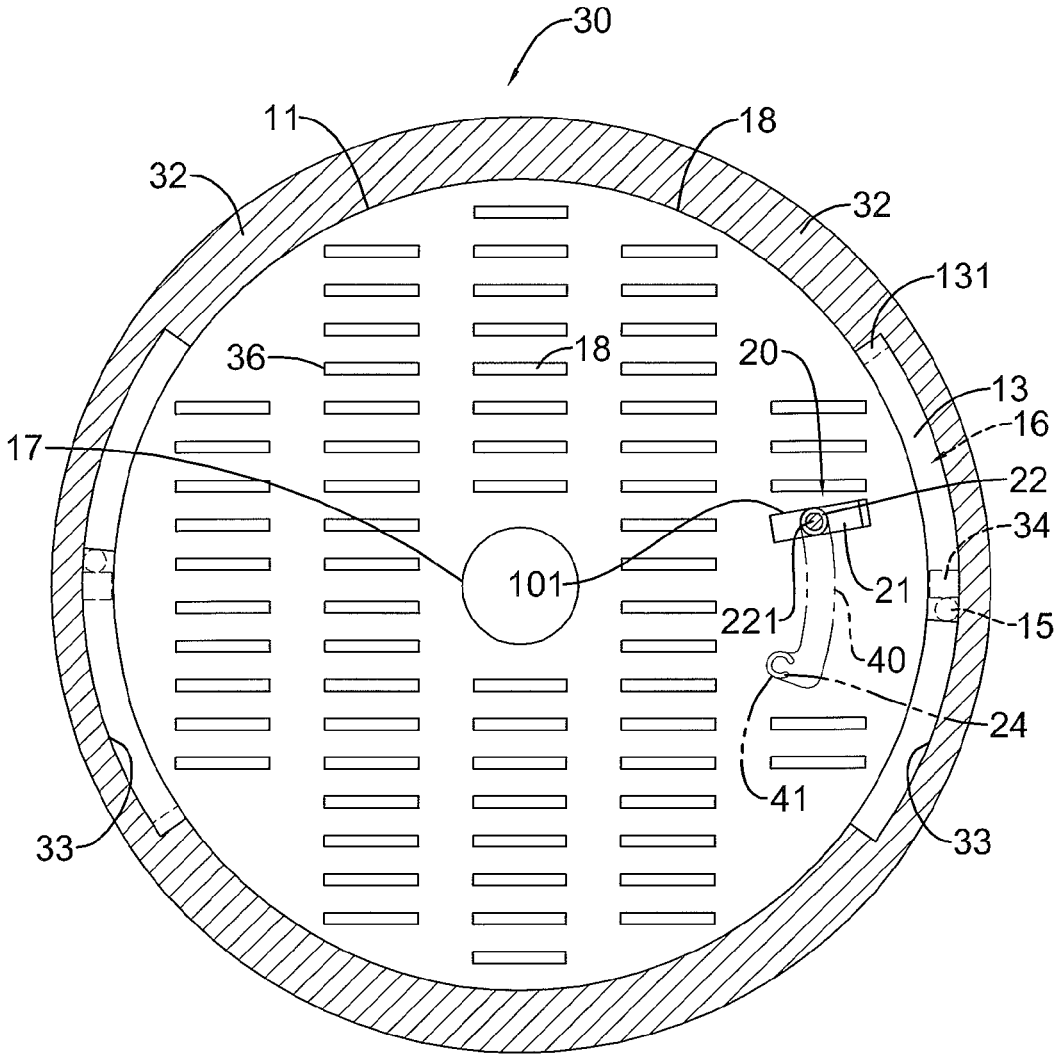
FIG. 8 is an operational cross-sectional front view of the disc weight in FIG. 7.

With reference to FIG. 8, when the lever 22 is intended to disengage from the closed end of the curved end 41, the lever 22 is pushed away from the curved end 41 and further into other portion of the arced hole 40. The round cover 30 is then rotated relative to the round base 10 until the locating slots 18 align with the locating holes 36. After weight plates 50 or coins are inserted into the corresponding locating slots 18 through the corresponding locating holes 36, the round cover 30 is further rotated relative to the round base 10 until the reduced neck 221 is retained and positioned by the retaining clip 24 again.

Figure 10:
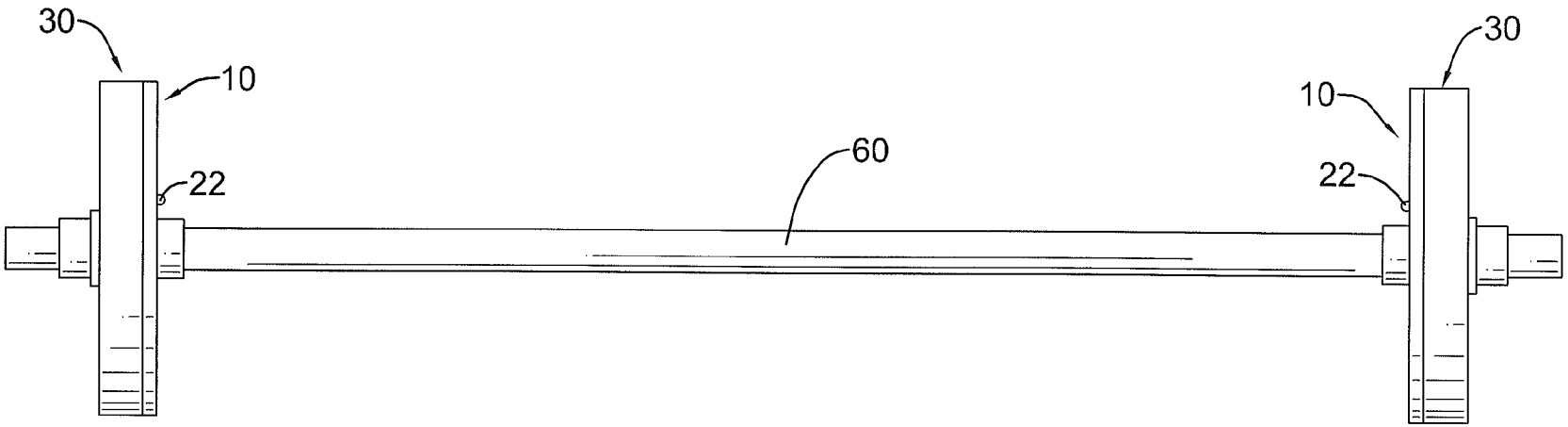
FIG. 10 is a side view of the weightlifting apparatus in FIG. 1.

With further reference to FIG. 10 and the foregoing drawings, the weightlifting apparatus in accordance with the present invention further has a bar 60. The round bases 10 and round covers 30 are respectively mounted around two ends of a bar 60 so that the bar 60 penetrates through the center holes 17 of the round base 10 and the center holes 35 of the round covers 30 and a dumbbell or a barbell can be implemented. The round bases 10 of the disc weights can be securely and respectively mounted around the two ends of the bar 60 together by welding.

With alignment and misalignment of the locating slots 18 of the round base 10 and the locating holes 36 of the round cover 30, multiple weight plates or coins can be inserted into the corresponding locating slots 18 through the corresponding locating holes 36 of the round cover 30 and locked inside the corresponding locating slots 18. Additionally, the weight plates or coins can be of different light weights, such as 100 g, 200 g and 500 g. Selection of type and number of the light weights can result in a desired fine weight adjustment without incurring excessive weight increment that may get the weight lifter injured. Furthermore, since using multiple lightweight weight plates or coins can adjust the weight of the disc weights incrementally, it is unnecessary for users to buy a full set of disc weights of different weights to achieve the same weight adjustment.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A weightlifting apparatus comprising multiple disc weights, each disc weight comprising:

a round base having:

an annular sidewall;

an annular flange formed on and protruding from the annular sidewall of the round base;

at least one limiting rib, each one of the at least one limiting rib formed on the annular sidewall of the round base and having:

a fence portion circumferentially formed on the annular sidewall;

a stop portion formed between one end of the fence portion and the annular flange; and an opening formed between the other end of the fence portion and the annular flange, and being opposite to the stop portion;

at least one sliding space, each one of the sliding space defined between the annular flange and a corresponding limiting rib;

a center hole centrally formed through the round base; and multiple locating slots and a fixing slot formed in one side of the round base opposite to the annular flange;

an engagement tab having:

a slider slidably mounted in the fixing slot of the round base; and a lever mounted on the slider and protruding beyond the fixing slot; and a round cover having:

a circular board;

an annular wall formed on a perimeter of the circular board;

an open chamber defined by the circular board and the annular wall;

at least one recess formed in an inner wall of the annular wall and being equal to the at least one limiting rib in number;

at least one locating pin, each one of the at least one locating pin formed on an inner wall of one of the at least one recess;

a center hole centrally formed through the circular board;

multiple locating holes formed through the circular board; and an arced hole formed through the circular board and having a curved end located at one end of the arced hole and communicating with the rest portion of the arced hole;

wherein when the round cover is mounted on the round base, the at least one recess respectively corresponds to and aligns with the at least one limiting rib, an arc length of each one of the at least one recess is longer than that of each one of the at least one limiting rib, each one of the at least one locating pin is mounted in a corresponding sliding space through the opening of a corresponding limiting rib, the lever of the engagement tab is inserted in the curved end of the arced hole and is moved to one end of the arced hole opposite to the curved end so that the locating holes of the round cover respectively align with the locating slots of the round base.

2. The weightlifting apparatus as claimed in claim 1, wherein the round base of each disc weight further has:

at least one through hole formed through the annular flange, each one of the at least one through hole aligning with the opening of one of the at least one limiting rib; and at least one blocking pin, each one of the at least one blocking pin mounted through one of the at least one through hole to block the opening of a corresponding limiting rib.

3. The weightlifting apparatus as claimed in claim 2, wherein the engagement tab of each disc weight further has a spring mounted in the fixing slot, one end of the spring abuts against an inner wall of the fixing slot, and the other end of the spring abuts against one side of the slider.

4. The weightlifting apparatus as claimed in claim 2, wherein the engagement tab of each disc weight further has a reduced neck formed at a junction between the lever and the slider, and the curved end of the arced hole has a retaining clip positioning the reduced neck when the reduced neck is retained by the retaining clip.

5. The weightlifting apparatus as claimed in claim 2 further comprising a bar, wherein the disc weights are respectively mounted around two ends of the bar.

6. The weightlifting apparatus as claimed in claim 5, wherein the round base of each disc weight is securely and respectively mounted around the two ends of the bar together by welding.

7. The weightlifting apparatus as claimed in claim 6 further comprising multiple weight plates, wherein the weight plates are inserted into the locating slots through the corresponding locating holes when the round base is rotated relative to the round cover and the locating slots align with the locating holes, and the weight plates are retained in the corresponding locating slots after the locating slots misalign with the locating holes.

8. The weightlifting apparatus as claimed in claim 2 further comprising multiple weight plates, wherein the weight plates are inserted into the locating slots through the corresponding locating holes when the round base is rotated relative to the round cover and the locating slots align with the locating holes, and the weight plates are retained in the corresponding locating slots after the locating slots misalign with the locating holes.

9. The weightlifting apparatus as claimed in claim 1, wherein the engagement tab of each disc weight further has a spring mounted in the fixing slot, one end of the spring abuts against an inner wall of the fixing slot, and the other end of the spring abuts against one side of the slider.

10. The weightlifting apparatus as claimed in claim 1, wherein the engagement tab of each disc weight further has a reduced neck formed at a junction between the lever and the slider, and the curved end of the arced hole has a retaining clip positioning the reduced neck when the reduced neck is retained by the retaining clip.

11. The weightlifting apparatus as claimed in claim 1 further comprising a bar, wherein the disc weights are respectively mounted around two ends of the bar.

12. The weightlifting apparatus as claimed in claim 11, wherein the round base of each disc weight is securely and respectively mounted around the two ends of the bar together by welding.

13. The weightlifting apparatus as claimed in claim 12 further comprising multiple weight plates, wherein the weight plates are inserted into the locating slots through the corresponding locating holes when the round base is rotated relative to the round cover and the locating slots align with the locating holes, and the weight plates are retained in the corresponding locating slots after the locating slots misalign with the locating holes.

14. The weightlifting apparatus as claimed in claim 1 further comprising multiple weight plates, wherein the weight plates are inserted into the locating slots through the corresponding locating holes when the round base is rotated relative to the round cover and the locating slots align with the locating holes, and the weight plates are retained in the corresponding locating slots after the locating slots misalign with the locating holes.

* * * * *